US005281173A

United States Patent [19]

Cherry et al.

[11] Patent Number: 5,281,173

[45] Date of Patent: Jan. 25, 1994

[54] ELECTRICAL DISTRIBUTION SYSTEM CONNECTOR

[75] Inventors: Hitesh Cherry; Michael A. Kandros; Daniel V. Nardone, all of Harrisburg; Nancy L. Reeser, Lemoyne, all of Pa.

[73] Assignee: The Whitaker Corporation, Wilmington, Del.

[21] Appl. No.: 28,848

[22] Filed: Mar. 10, 1993

[51] Int. Cl.[5] ..... H01R 4/50

[52] U.S. Cl. ..... 439/783; 439/790; 439/863

[58] Field of Search ..... 439/783, 790, 863

[56] References Cited

U.S. PATENT DOCUMENTS

| | | | |
|---|---|---|---|
| 2,106,724 | 2/1938 | Cope | 439/783 |
| 3,280,856 | 10/1966 | Broske et al. | 439/783 |
| 4,059,333 | 11/1977 | Mixon, Jr. | 439/783 |
| 5,006,081 | 4/1991 | Counsel et al. | 439/783 |

*Primary Examiner*—Paula A. Bradley
*Attorney, Agent, or Firm*—William B. Noll

[57] ABSTRACT

A connector (10) for an electrical distribution system includes an internal member or wedge (12) received within an external member (11) having an inherent resiliency. The external member (11) has a pair of end portions (15, 16), each of which has an opening (17, 18) to receive a respective wire (13, 14), and the wires (13, 14) are clamped mechanically between the side edges of the internal member or wedge (12) and the respective end portions (15, 16) of the external member (11). No special tool is required, either for the initial installation or subsequent disassembly for repair or replacement, and the inherent resiliency of the external member (11) accommodates any material creepage or dimensional instability in the wire material due to line current variations or adverse weather conditions, particularly where aluminum wires are used.

9 Claims, 5 Drawing Sheets

ELECTRICAL DISTRIBUTION SYSTEM CONNECTOR

FIELD OF THE INVENTION

The present invention relates to a connector for an electrical distribution system, and more particularly, to a connector for quickly connecting (or subsequently disconnecting) two wires without requiring a special tool.

BACKGROUND OF THE INVENTION

In the installation and maintenance of electrical distribution systems, such as distribution transformers or substations, it is necessary to connect respective pairs of leads or wires and to maintain a solid mechanical retention of the wires as well as a good electrical connection therebetween despite fluctuations in the line current or severe weather conditions.

The wires may run from around 1/16 inch in diameter to around ⅝ of an inch for plier-applied connectors, depending upon the particular distribution system or subsystem. The smaller sized wires are usually made of aluminum or copper or a combination thereof for normal household currents; and the larger wires, which are primarily intended for outdoor distribution systems, are usually made of aluminum provided with a steel wire core.

The aluminum wire tends to "creep", that is, it lacks good dimensional stability; and the particular connector between the wires may not effectively compensate for that dimensional instability in the wire material.

The existing connectors used in junction boxes for residential duty and the like usually include a pair of clamping members drawn up tight by means of a screw therebetween. The screw may vibrate loose and, besides, there is no built-in compensation for material creepage.

In heavy-duty applications, the existing connectors may use a power actuated portable tool to drive a wedge into the connector, thereby retaining the wires mechanically and making the necessary electrical connection therebetween. Such a tool is supplied by AMP Incorporated (of Harrisburg, Pa.) under its trademark "AMPACT".

While perfectly suitable for the purposes intended, nevertheless, this is a special tool which may not be readily available to installers or maintenance personnel out in the field. Besides, each "shot" of this tool requires a cartridge, the cost of which may run around $1.00.

SUMMARY OF THE INVENTION

Accordingly, it is an object of the present invention to provide a connector for mechanically retaining and electrically connecting two wires in an electrical distribution system, wherein the connector is simple, cost effective, and is substantially "tool less" (that is, does not require any special tool).

In accordance with the teachings of the present invention, there is herein disclosed and claimed, a preferred embodiment of a connector for mechanically retaining and electrically connecting two wires in an electrical distribution system. This connector includes an external member having first and second end portions confronting one another; and each of the end portions is provided with an opening, such that the respective openings communicate therebetween, and such that the wires are received in the respective openings. The external member further has an intermediate portion connecting the first and second end portions thereof, and the intermediate portion includes a bight portion disposed laterally of the respective end portions of the external member. This bight portion includes means therein providing an inherent resiliency in the external member, such that the first and second end portions of the external member may be spread apart. An internal member is received within the external member, between the respective communicating openings therein, and laterally of the intermediate portion of the external member. As a result, one of the wires is clamped mechanically between the internal member and the first end portion of the external member, while the other wire is clamped mechanically between the internal member and the second end portion of the external member. At least one of the members is made from a conductive material, such that the wires are electrically connected together.

With this structure, any creepage of the aluminum wires (particularly heavy-gauge aluminum wires used in outdoor distribution systems) is accommodated by the inherent resiliency of the external member, such that a good electrical and mechanical connection is maintained despite line current surges or fluctuations due to load variations in the system and, occasionally, adverse weather conditions.

These and other objects of the present invention will become apparent from a reading of the following specification taken in conjunction with the enclosed drawings.

GENERAL DESCRIPTION OF THE PREFERRED EMBODIMENT

Figure 1:
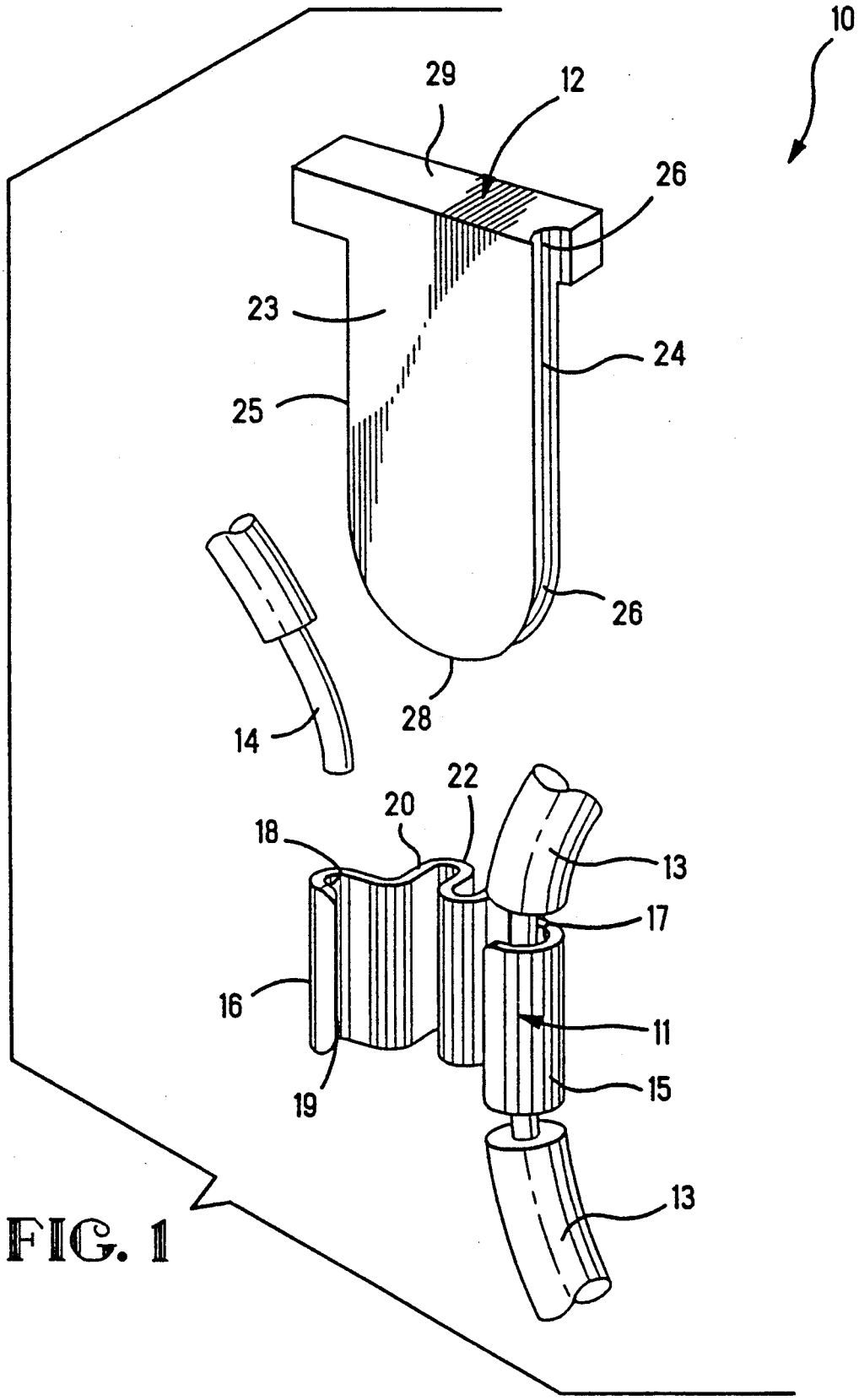
FIG. 1 is an exploded perspective of the components of a preferred embodiment of the connector of the present invention, showing the internal member ready to be inserted into the external member to retain and connect the two wires.
Figure 2:
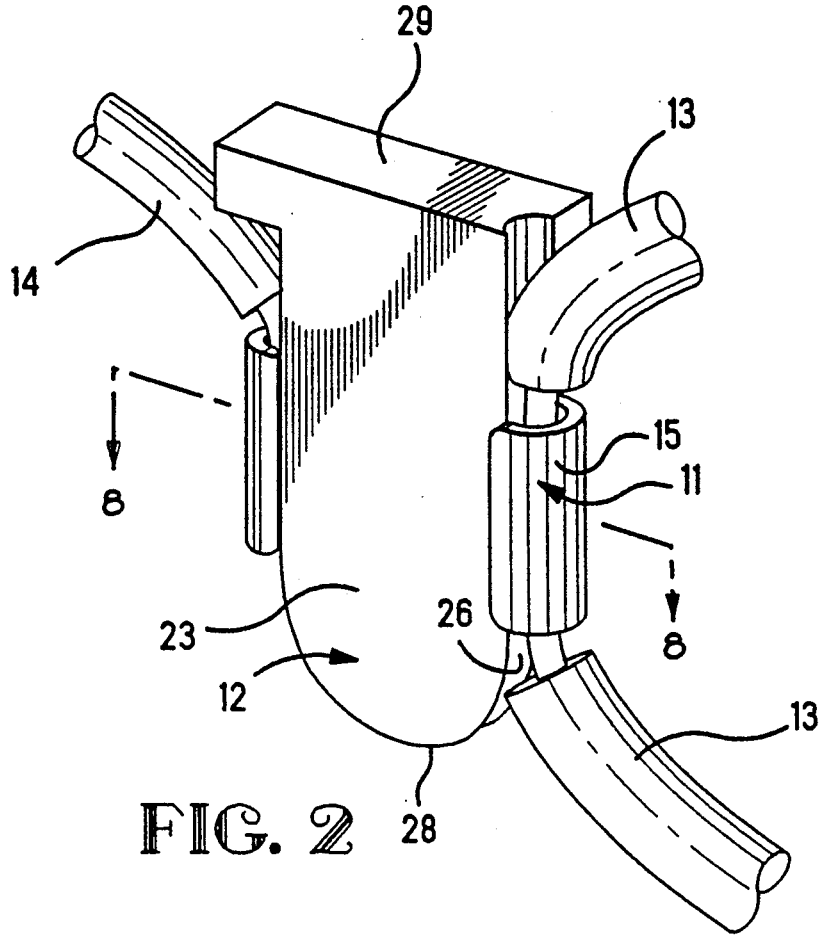
FIG. 2 is a perspective of the assembled connector of FIG. 1.

With reference to FIGS. 1 and 2, the connector 10 of the present invention comprises an external member 11 and an internal member 12 for mechanically retaining and electrically connecting two wires, 13 and 14, together.

Figure 3:
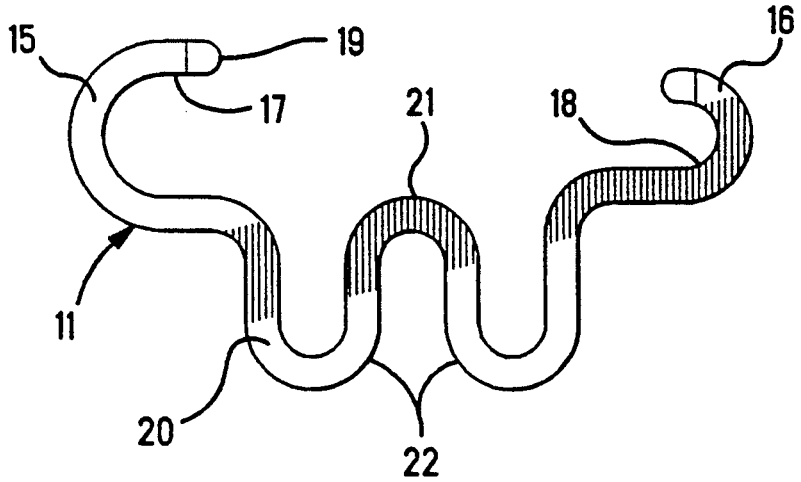
FIG. 3 is a top plan view of the external member in the connector.

With further reference to FIG. 3, the external member 11 has first and second end portions 15 and 16, respectively, which confront one another. Each of the end portions 15 and 16 is provided with an opening 17 and 18, respectively, and the openings 17 and 18 communicate therebetween. The end portions 15, 16 define therebetween a slot 19 in the external member 11.

The external member 11 further has an intermediate portion 20 connecting the first and second end portions 15 and 16, respectively, and the intermediate portion 20 includes a bight portion 21 disposed laterally of the respective end portions 15, 16 of the external member 11. The bight portion 21 includes a double loop 22, shown more clearly in FIG. 3, thereby providing an inherent resiliency in the external member 11. This inherent resiliency allows the external member 11 to function as a powerful spring clip; and the respective end portions 15, 16 of the external member 11 may be spread apart (slightly) in the initial clamping of the wires 13, 14 or in the subsequent disassembly of the connector 10 (as hereinafter discussed).

The internal member 12 cooperates with the external member 11 and functions as a wedge. More specifically, the internal member (or wedge) 12 is received within the external member 11, between the respective communicating openings 17, 18 therein, and laterally of the intermediate portion 20 of the external member 11. As a result, one of the wires, 13, is clamped mechanically between the internal member 12 and the first end portion 15 of the external member 11, while the other wire 14 is clamped mechanically between the internal member 12 and the second end portion 16 of the external member 11.

At least one of the external and internal members 11 and 12, respectively, is made from a conductive material, such that the wires 13 and 14 are electrically connected together. Preferably, both the external member 11 and the internal member 12 are made of a conductive material; and in the preferred embodiment, are both made of aluminum. If desired, the external member 11 may be made from an aluminum extrusion (not shown herein) and cut-off to length, while the internal member 12 may be made from a die-cast aluminum. Both the external member 11 and the internal member 12 may be suitably deburred and surface finished in production. It will be appreciated by those skilled in the art, however, that other suitable manufacturing methods are equally feasible within the teachings of the present invention.

With further reference to FIGS. 4–8, the internal member (or wedge) 12 includes a substantially planar portion 23 having respective parallel side edges 24 and 25. These side edges 24, 25 have grooves 26 and 27, respectively, formed therein to receive the wires 13 and 14, respectively. These grooves 26, 27 (as shown more clearly in FIGS. 7 and 8) have respective arcuate profiles to accommodate the substantially round wire.

In this preferred embodiment, the opening 17 in the first end portion 15 of the external member 11 is formed on a larger radius than the radius for the opening 18 in the second end portion 16 thereof, while the arcuate groove 26 in the first side edge 24 of the planar portion 23 of the internal member (or wedge) 12 is larger than the arcuate groove 27 in the second side edge 25 of the planar portion 23. However, if desired, the openings 17, 18 and the arcuate grooves 26, 27 may be identical, if desired, or have any sized radius which is suitable for a particular purpose or installation.

Figure 4:
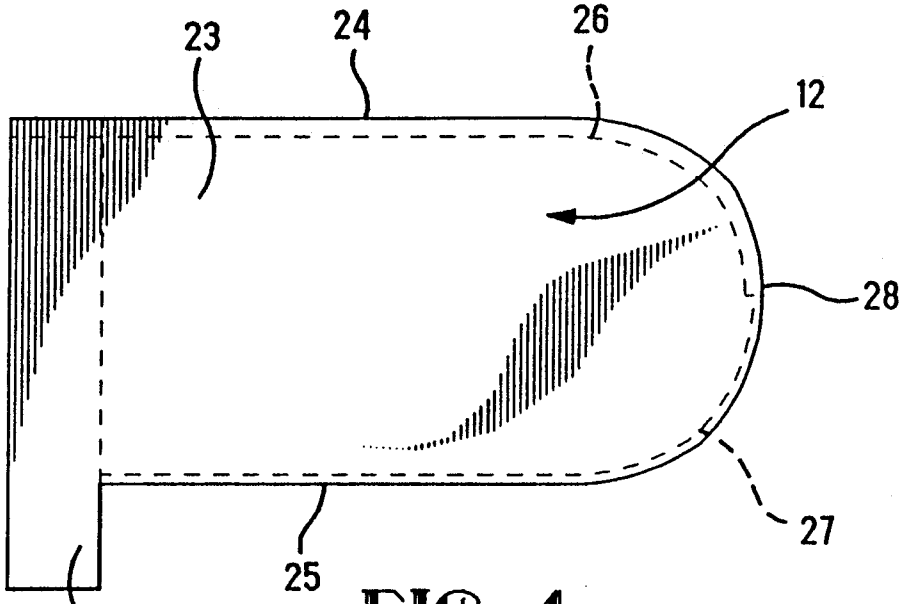
FIG. 4 is a top plan view of the internal member in the connector.
Figure 5:
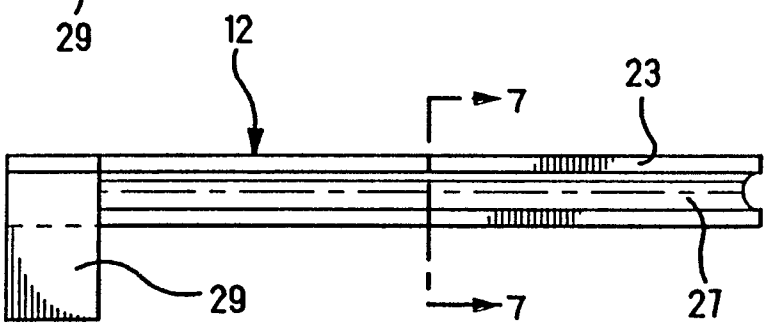
FIG. 5 is a side elevational view thereof.
Figure 6:
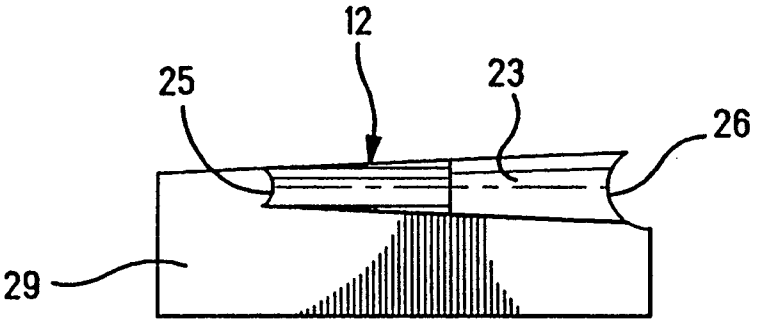
FIG. 6 is an end view thereof.
Figure 7:
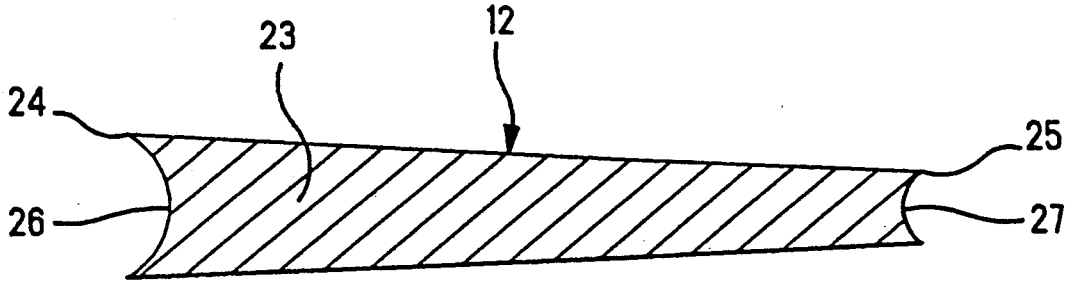
FIG. 7 is a cross-sectional view thereof, taken along the lines 7—7 of FIG. 3, and drawn to an enlarged scale.
Figure 8:
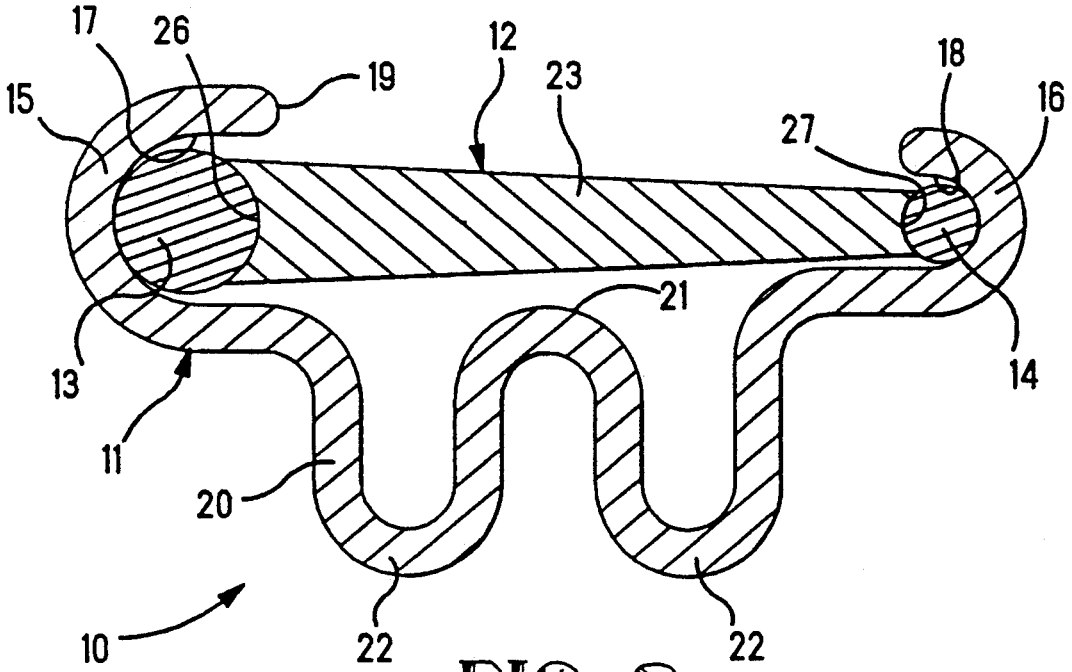
FIG. 8 is a cross-sectional view, taken across the lines 8—8 of FIG. 2 and enlarged in scale, and showing the assembled connector of the present invention, wherein the respective end portions of the external member are spread apart slightly.

The planar portion 23 of the internal member (or wedge) 12 has a forwardmost portion 28 which is rounded, as shown more clearly in FIG. 4, thereby facilitating the insertion of the planar portions 23 of the internal member (or wedge) 12 into the external member 11. Moreover, the planar portion 23 is tapered from the larger arcuate groove 26 towards the smaller arcuate groove 27, as shown more clearly in FIGS. 7 and 8, to accommodate the different diameter wires 13, 14 and increase the respective clamping forces thereon.

Figure 9:
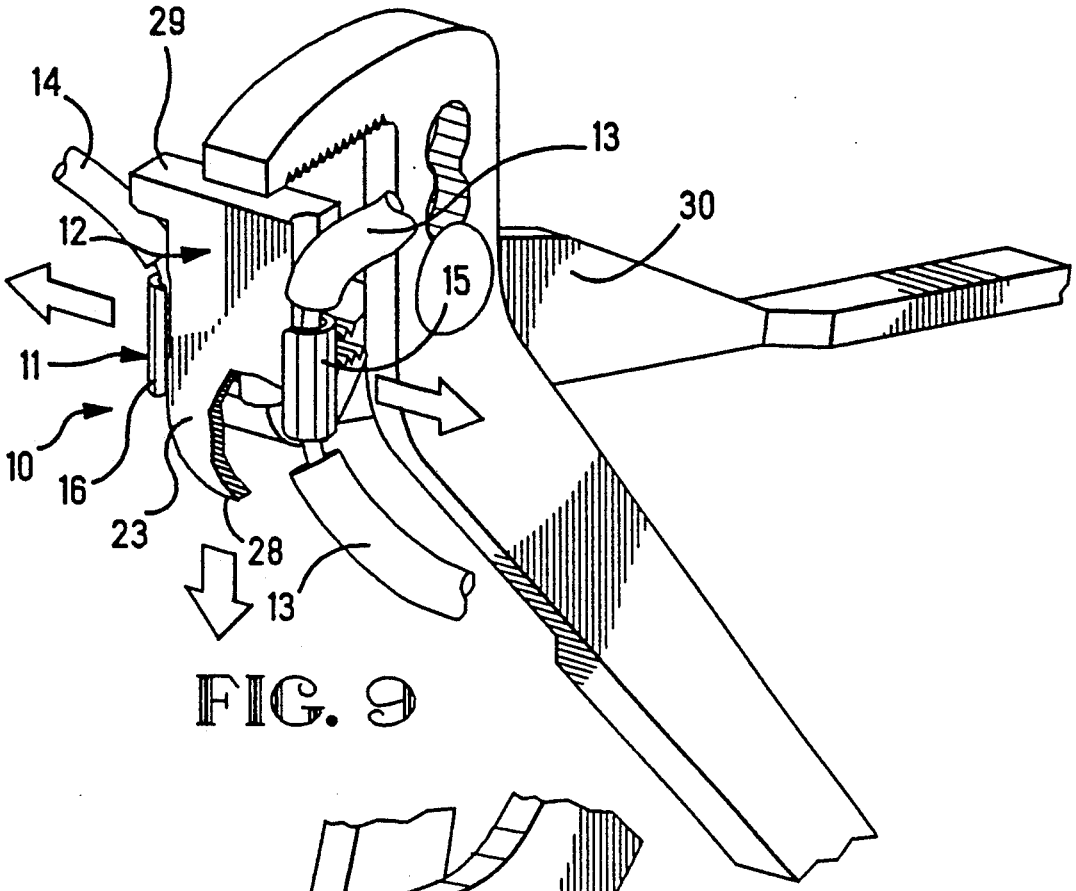
FIG. 9 is a perspective showing how an adjustable pliers may be used to insert the internal member into the external member, thereby causing the respective wires to be wedged between the internal and external members during the initial installation.

With reference to FIG. 9, the internal member (or wedge) 12 further has a rearward portion provided with a tab 29 projecting substantially perpendicularly of the planar portion 23. An adjustable pliers 30 (or other suitable tool) has a pair of jaws, one of which engages the tab 29 on the internal member (or wedge) 12, and the other of which engages the opposite side of the external member 11. When the jaws of the pliers 30 are manually closed, the internal member (or wedge) 12 is inserted into the external member 11. This causes the wires 13 and 14 to be wedged between the internal member (or wedge) 12 and the external member 11.

Figure 10:
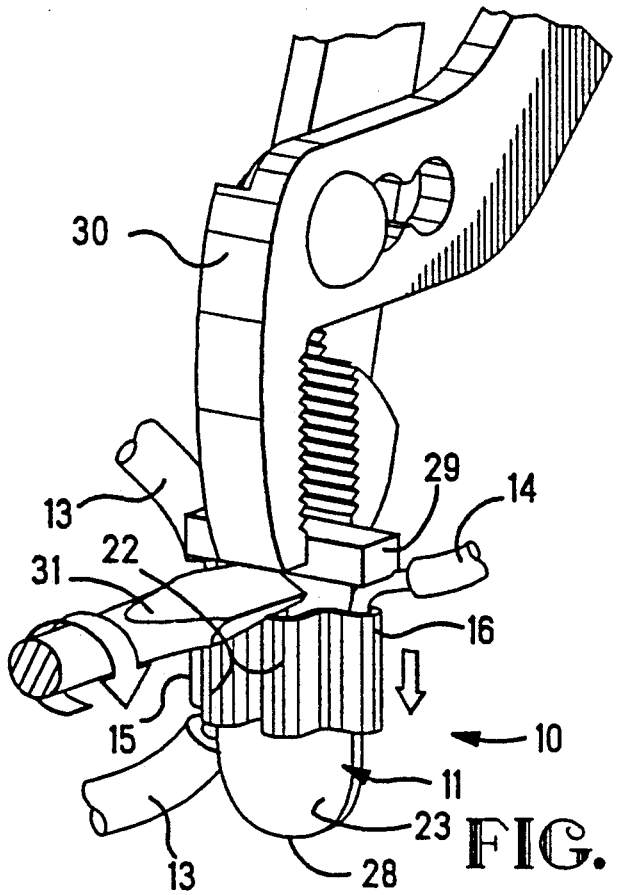
FIG. 10 is a still further perspective view, corresponding substantially to that of FIG. 9, but showing how a screwdriver may be inserted between the external member and the tab on the internal member, then twisted, while the pliers may grip the tab on the internal member to lift the internal member out of the external member.

Thereafter, and as shown more clearly in FIG. 10, a screwdriver 31 (or other suitable hand tool) may be inserted between the external member 11 and the tab 29 on the internal member 12, and thereafter twisted, while the pliers 30 may simultaneously grip the tab 29 and pull or lift the internal member (or wedge) 12 out of the external member 11.

Accordingly, the present invention provides a simple, effective and low-cost connector to mechanically retain and electrically connect a pair of wires in an electrical distribution system. Any dimensional instability of the wires due to material creepage is readily compensated for, and the initial installation as well as any subsequent disassembly is easy and convenient and saves time out in the field. No special tools are required and, instead, the conventional hand tools normally found in a lineman's tool kit may be used.

Obviously, many modifications may be made without departing from the basic spirit of the present invention. For example, the connector 10 and its components 11 and 12 may be made of any suitable size or material for a specific purpose or installation. Accordingly, it will be appreciated by those skilled in the art that within the scope of the appended claims, the invention may be practiced other than has been specifically described herein.

We claim:

1. A connector for mechanically retaining and electrically connecting two wires in an electrical distribution system, comprising an external member having first and second end portions confronting one another, each of which end portions is provided with an opening, such that the respective openings communicate therebetween, and such that the wires are received in the respective openings, the external member further having an intermediate portion connecting the first and second end portions thereof, the intermediate portion including a bight portion disposed laterally of the respective end portions of the external member, the bight portion having a double loop formed in the bight portion of the intermediate portion of the external member to provide an inherent resiliency in the external member, such that the first and second end portions of the external member may be spread apart, and an internal member received within the external member, between the respective communicating openings therein, and laterally of the intermediate portion of the external member, such that one of the wires is clamped mechanically between the internal member and the first end portion of the external member, and such that the other wire is clamped mechanically between the internal member and the second end portion of the external member, and at least one of the members being made from a conductive material, such that the wires are electrically connected together.

2. The connector of claim 1, wherein both the external member and the internal member are made of metal.

3. The connector of claim 1, wherein at least one of the wires is made of aluminum.

4. The connector of claim 1, wherein the internal member comprises a wedge including a substantially planar portion having respective first and second side edges which are substantially parallel to each other.

5. The connector of claim 4, wherein the planar portion of the wedge has a forwardmost portion which is rounded, thereby facilitating the insertion of the planar portion of the wedge into the external member.

6. The connector of claim 5, wherein the wedge further has a rearward portion provided with a tab, the tab projecting perpendicularly of the planar portion of the wedge, such that a manual grasping of the wedge if acilitated.

7. The connector of claim 4, wherein the first and second side edges of the planar portion of the wedge have respective grooves formed therein to receive the respective wires.

8. The connector of claim 7, wherein the respective opening in the first end portion of the external member is larger than the respective opening in the second end portion of the external member, and wherein the planar portion of the wedge has a transverse cross-section which is tapered in the direction of the first end portion to the second end portion of the external member.

9. The connector of claim 8, wherein the respective grooves in the side edges of the planar portion of the wedge have a transverse cross-section which is substantially arcuate, being formed on a radius; and wherein the respective groove in the first side edge of the planar portion of the wedge is formed on a radius which is larger than the radius for the groove in the second side edge thereof.

* * * * *